US006012587A

United States Patent [19]

McCullough

[11] Patent Number: 6,012,587

[45] Date of Patent: Jan. 11, 2000

[54] PALLET LOAD CORNER PROTECTOR WITH LOCKING TABS

[75] Inventor: Larry S. McCullough, Salt Lake City, Utah

[73] Assignee: Tenneco Packaging Inc., Lake Forest, Ill.

[21] Appl. No.: 09/119,616

[22] Filed: Jul. 20, 1998

[51] Int. Cl.[7] ..... B65D 81/02

[52] U.S. Cl. ..... 206/586; 206/593; 206/453; 248/345.1; 53/139.7; 53/410; 493/137

[58] Field of Search ..... 206/586, 453, 206/593, 345.1; 53/139.7, 410; 493/84, 137, 374, 390

[56] References Cited

U.S. PATENT DOCUMENTS

| | | | |
|---|---|---|---|
| 1,808,651 | 6/1931 | Gibb et al. . | |
| 2,050,791 | 8/1936 | Graham | 206/586 |
| 2,185,920 | 1/1940 | Martin | 206/65 |
| 2,326,928 | 8/1943 | Courson | 206/65 |
| 2,570,340 | 10/1951 | George | 206/65 |
| 2,583,673 | 1/1952 | Storey | 229/40 |
| 2,610,735 | 9/1952 | Ferguson | 206/65 |
| 3,109,540 | 11/1963 | Klimpl | 206/65 |
| 3,249,412 | 5/1966 | Kolek et al. | 65/3 |
| 3,410,394 | 11/1968 | Jackson et al. | 206/59 |
| 3,613,985 | 10/1971 | Goodsite | 206/586 |
| 3,638,790 | 2/1972 | Schmid et al. | 206/65 S |
| 3,835,986 | 9/1974 | LeBeau | 206/320 |
| 3,850,294 | 11/1974 | Phillips et al. | 206/205 |
| 3,915,301 | 10/1975 | Gray et al. | 206/409 |
| 3,954,219 | 5/1976 | Mangini et al. | 229/23 A |
| 4,097,004 | 6/1978 | Reese | 242/129.72 |
| 4,141,447 | 2/1979 | Anderson | 206/392 |
| 4,142,634 | 3/1979 | Leff et al. | 206/392 |
| 4,147,253 | 4/1979 | Brook et al. | 206/205 |
| 4,201,138 | 5/1980 | Cox | 108/55.1 |
| 4,202,448 | 5/1980 | Jaeger et al. | 206/392 |
| 4,247,021 | 1/1981 | Reiner et al. | 222/143 |
| 4,248,350 | 2/1981 | Gilbert | 206/586 |
| 4,265,184 | 5/1981 | Cox | 206/586 |
| 4,292,901 | 10/1981 | Cox | 206/586 |
| 4,399,915 | 8/1983 | Sorenson | 206/586 |
| 4,435,479 | 3/1984 | Pivoteau et al. | 428/542.8 |
| 4,516,677 | 5/1985 | Rowland et al. | 206/394 |
| 4,546,880 | 10/1985 | Reese | 206/410 |
| 4,595,093 | 6/1986 | Eckstein | 206/44 R |
| 4,667,823 | 5/1987 | Wolfe, Jr. et al. | 206/392 |
| 4,762,750 | 8/1988 | Girgis et al. | 428/378 |
| 4,762,751 | 8/1988 | Girgis et al. | 428/378 |
| 4,998,619 | 3/1991 | Sowa et al. | 206/392 |
| 5,147,040 | 9/1992 | Koike et al. | 206/410 |
| 5,344,014 | 9/1994 | Toral et al. | 206/394 |
| 5,363,962 | 11/1994 | Toral et al. | 206/394 |
| 5,396,990 | 3/1995 | Bell et al. | 203/391 |
| 5,409,114 | 4/1995 | Myers et al. | 206/394 |
| 5,531,327 | 7/1996 | Darby | 206/600 |
| 5,551,563 | 9/1996 | Allen | 206/394 |
| 5,624,031 | 4/1997 | Fowler et al. | 206/391 |

*Primary Examiner*—Paul T. Sewell
*Assistant Examiner*—J. Mohandesi
*Attorney, Agent, or Firm*—Arnold White & Durkee

[57] ABSTRACT

A corner protector for protecting a load of products stacked on a pallet. The corner protector includes an upper end and a lower end. The corner protector further comprises first and second panels hingedly connected to each other along a central fold line and disposed generally perpendicular to each other. Each of the first and second panels include an inner layer and an outer layer. The inner layer of the first panel forms a first hinged locking flap disposed generally perpendicular to a remainder of the first panel and the inner layer of the second panel forms a second hinged locking flap disposed generally perpendicular to a remainder of the second panel. The first and second locking flaps are located at approximately the same distance from the upper end and are engaged to one another to maintain the first and second panels generally perpendicular to each other.

31 Claims, 4 Drawing Sheets

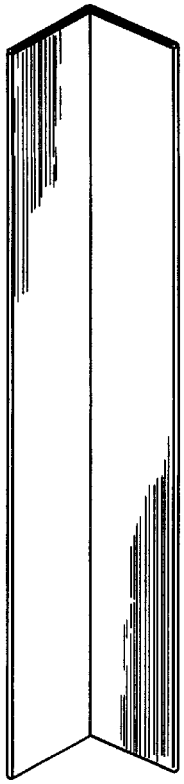
Fig. 1
(Prior Art)
Fig. 2
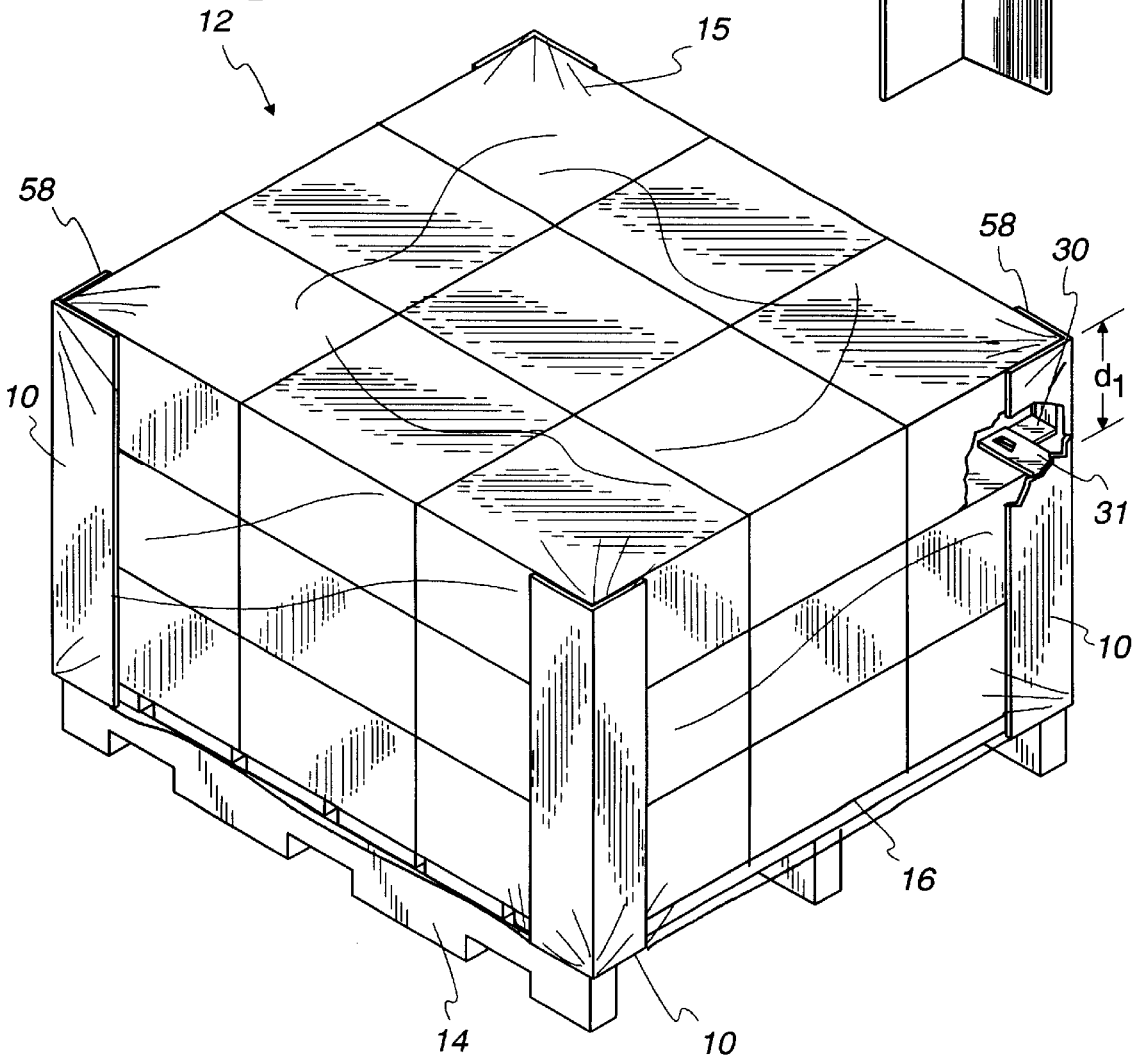

PALLET LOAD CORNER PROTECTOR WITH LOCKING TABS

FIELD OF THE INVENTION

The present invention relates to the packaging of products on pallets, and in particular, to a corner protector that holds itself in a generally L-shaped configuration for easy placement on the corners of a palletized load of box-shaped products.

BACKGROUND OF THE INVENTION

Various box-shaped products are transported from a manufacturer to a retail outlet by stacking a plurality of such products on pallets and winding stretch film around the box-shaped products to secure the load for shipping. However, there have been recurring problems with damage to the box-shaped products during transit. The damage is often encountered during shipment by common carrier. Moreover, existing corner protectors for protecting box-shaped products are difficult to place and maintain on a palletized load.

An example of an existing corner protector for packaging box-shaped products is illustrated in FIG. 1. The corner protector includes two generally perpendicular panels that are generally comprised of several layers of material. These corner protectors are shipped in their generally perpendicular state, necessitating awkward transportation and higher shipping costs. Furthermore, the existing corner protectors are difficult to place on a palletized load. These corner protectors must be held in place by hand or taped to the box-shaped units in order for the pallet to leave the packing station of a packing line. This necessitates extra personnel to maintain the four corner protectors on a palletized load or necessitates using tape with adhesive that sticks to the products being shipped. The present corner protector overcomes these disadvantages and provides an easy to ship and install corner protector.

SUMMARY OF THE INVENTION

An object of the present invention is to provide an inexpensive corner protector for protecting palletized loads of box-shaped products.

Another object of the present invention is to provide a corner protector that is easy to ship.

A further object of the present invention is to provide a corner protector that is easy to install and maintain on a corner of a palletized load.

Still another object of the present invention is to provide a corner protector that can be used with a variety of different size box-shaped units.

These and other objects of the invention are realized by providing a corner protector for protecting a load of products stacked on a pallet. The corner protector includes an upper end and a lower end. The corner protector further comprises first and second panels hingedly connected to each other along a central fold line and disposed generally perpendicular to each other. Each of the first and second panels include an inner layer and an outer layer. The inner layer of the first panel forms a first hinged locking flap disposed generally perpendicular to a remainder of the first panel and the inner layer of the second panel forms a second hinged locking flap disposed generally perpendicular to a remainder of the second panel. The first and second locking flaps are located at approximately the same distance from the upper end and are engaged to one another to maintain the first and second panels generally perpendicular to each other.

BRIEF DESCRIPTION OF THE DRAWINGS

Other objects and advantages of the invention will become apparent upon reading the following detailed description and upon reference to the drawings in which:

FIG. 1 is a perspective view of a prior art corner protector;

FIG. 2 is a perspective view of a palletized load with corner protectors embodying the present invention;

Figure 3:
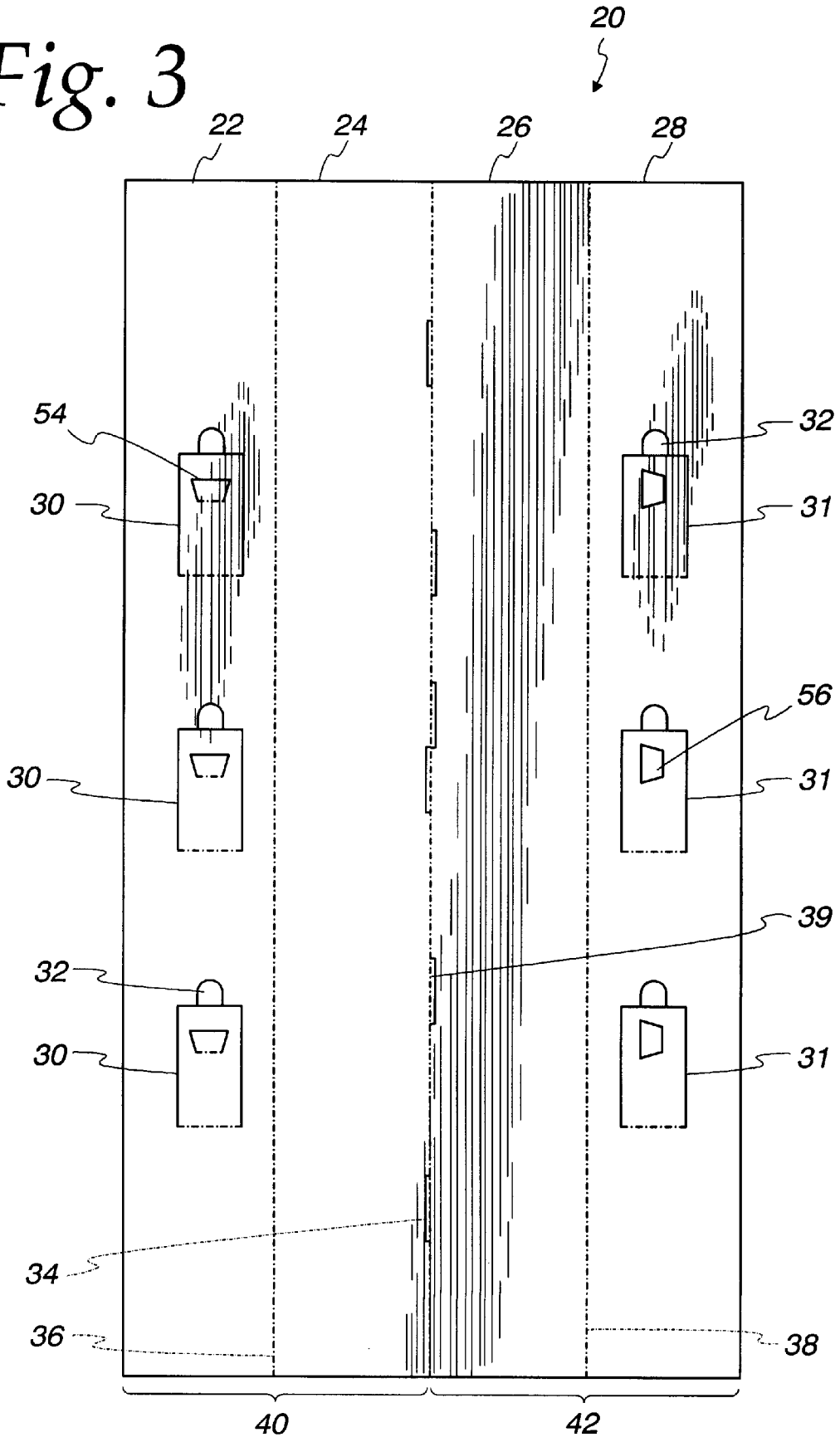
FIG. 3 is a top plan view of a blank used to form the corner protector of the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Turning now to the drawings, FIG. 2 depicts a palletized load 12 including a plurality of box-shaped units 16. Corner protectors 10 are placed along each vertical corner of the load 12. The corner protectors 10 protect the load 12 by preventing damage to the load 12 during transportation. The load 12 rests on a pallet 14 of ordinary construction. Stretch wrap film 15 is spirally wound about the load 12 and the corner protectors 10 in order to stabilize and tighten the load 12 during transportation.

FIG. 3 illustrates a blank 20 that is used to construct the corner protector 10. The blank 20 includes four generally rectangular sections 22, 24, 26 and 28. Sections 22 and 24 form a first panel 40 and sections 26 and 28 form a second panel 42, best illustrated in FIG. 4*a*. The blank 20 also includes first hinged locking flaps 30 and second hinged locking flaps 31. Adjacent to the first and second locking flaps 30 and 31 are thumb holes 32 for easily pulling the locking flaps away from the respective panels 40 and 42 of the folded blank 20 such that the locking flaps are disposed generally perpendicular to the remainder of the respective panels. A central fold line 34 divides the blank 20 into two approximately equal areas comprising sections 22 and 24 on one side and sections 26 and 28 on the other side of the central fold line 34. Sections 22 and 24 are hingedly connected to each other about a first generally vertical fold line 36 and sections 26 and 28 are hingedly connected to each other about a second generally vertical fold line 38.

Figure 4A:
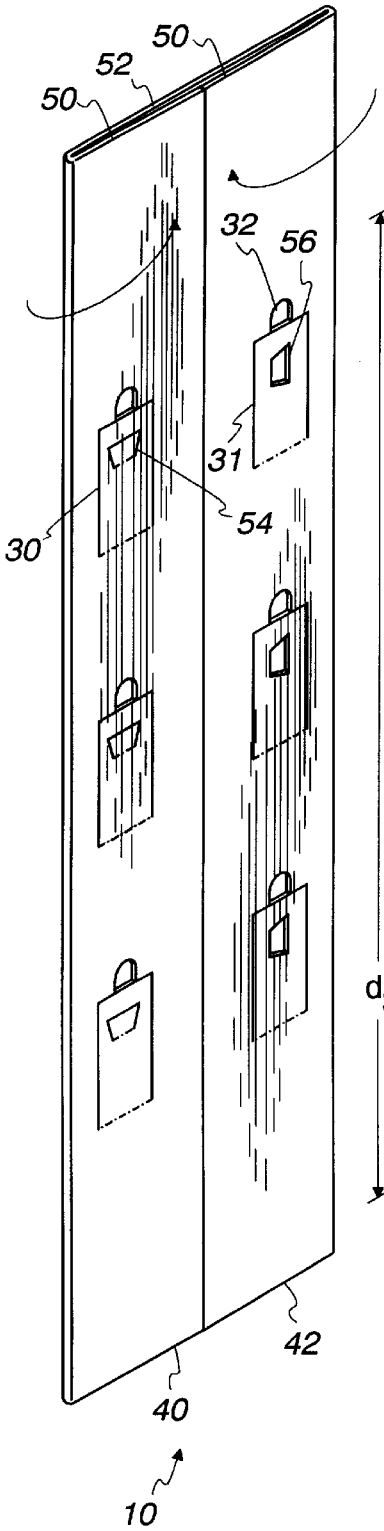
FIG. 4*a* is a perspective view of the blank of FIG. 3 after it has been folded to form an inner and an outer layer.

The blank 20, illustrated in FIG. 3, is formed into the flattened corner protector 10, illustrated in FIG. 4*a*, as follows. The first and second panels 40 and 42 each have an inner layer 50 and an outer layer 52, as illustrated in FIG. 4*a*. The inner layer 50 is comprised of sections 22 and 28 while the outer layer is comprised of sections 24 and 26. The sections 22 and 28 are folded about fold lines 36 and 38, respectively. The sections 22 and 28 are adhered to the sections 24 and 26, respectively, to form double layer panels 40 and 42. In one embodiment, the sections 22, 24, 26 and 28 are composed of corrugated cardboard. The structure of corrugated cardboard has inherent cushioning characteristics important to protecting the box-shaped units 16. Additionally, corrugated cardboard is readily recyclable so that the end user's cost of disposal and volume of material to be disposed is greatly reduced.

Figure 4B:
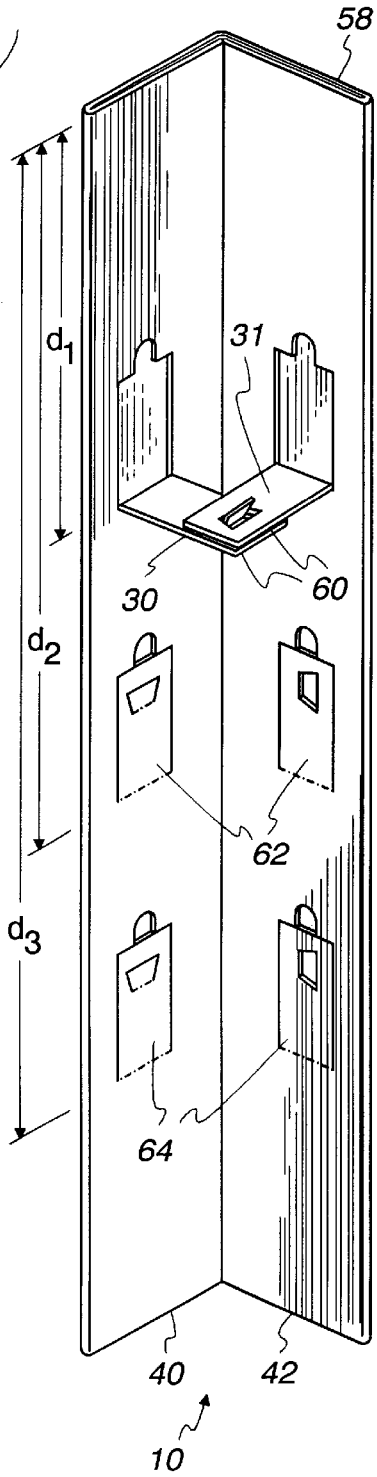
FIG. 4*b* is a perspective view of one orientation of an assembled corner protector according to the present invention.
Figure 4C:
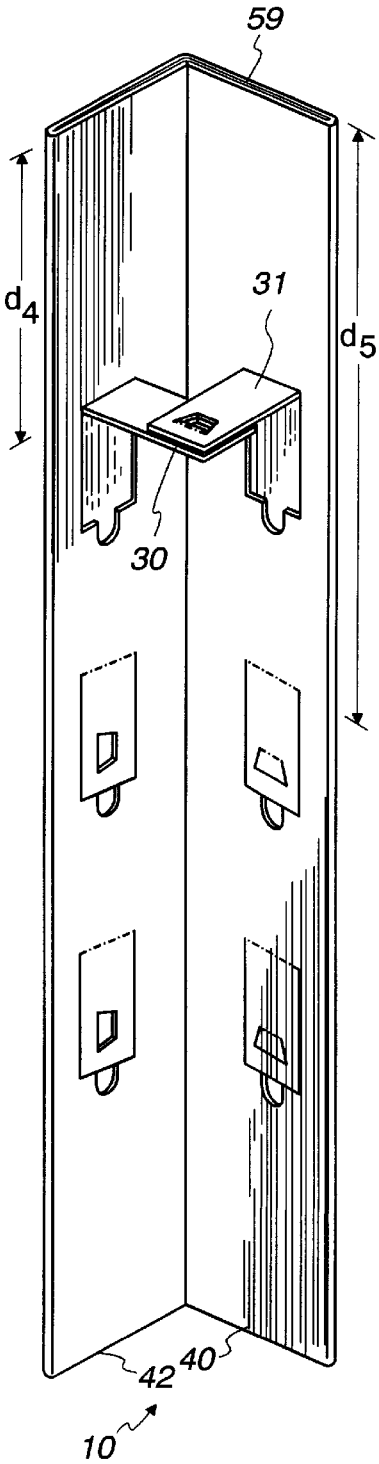
FIG. 4*c* is a perspective view of another orientation of an assembled corner protector according to the present invention.

As illustrated in FIG. 4*a*, the double layer panels 40 and 42 of the corner protector 10 lie flat for easy shipment. Once the corner protector is received, the first and second panels 40 and 42 are folded relative to each other about central fold line 34 such that the first panel 40 and the second panel 42 are disposed generally perpendicular to each other, as illustrated in FIGS. 4*b* and 4*c*. A plurality of slits 39 are intermittently located along the central fold line 34 to help maintain the first and second panels 40 and 42 generally perpendicular to each other. Next, one set of the first and second hinged locking flaps 30 and 31 are folded outward such that each flap is disposed generally perpendicular to the remainder of the first and second panels 40 and 42, respectively. In one embodiment, the inner layer 50 of the first panel 40 is formed with the finger hole 32 adjacent to the first locking flap 30 and the inner layer 50 of the second panel 42 is formed with a finger hole 32 adjacent to the second locking flap 31. This allows the user to easily access and grasp the locking flaps 30 and 31 and fold selected ones of those locking flaps outward.

The first locking flap 30 includes a locking tab 54 and the second locking flap 31 includes an aperture 56 for receiving the locking tab 54. In one embodiment, the first hinged locking flap 30 and the second hinged locking flap 31 are hinged at approximately the same distance $d_1$ from the upper end 58 of the corner protector 10. Then, the first hinged locking flap 30 is engaged with the second hinged locking flap 31 such that the first and second panels 40 and 42 are maintained generally perpendicular to each other. In one embodiment, the aperture 56 and the locking tab 54 are generally trapezoidal in shape. Forming the first and second locking flaps 30 and 31 at approximately the same distance from the upper end of the corner protector allows for proper mating of the locking flaps 30 and 31 in a generally perpendicular orientation with respect to the first and second panels 40 and 42, respectively.

Thus, the design of the corner protector 10 makes it easy to assemble and install. For instance, the slits 39 allow the locking flaps 30 and 31 to be easily interconnected because the corner protector 10 is already being held in place in a generally perpendicular orientation. Furthermore, the interconnected locking flaps 30 and 31 allow the corner protector 10 to be easily installed on the palletized load 12. For example, referring again to FIG. 2, multiple tiers of box-shaped units 16 are depicted. The number of box-shaped units 16 in a tier and the number of tiers making up a palletized load 12 will vary with the characteristics, such as the weight and the dimensions, of the box-shaped units 16. If, for example, the plurality of box-shaped units 16 includes three tiers of box-shaped units 16, then the box-shaped units 16 of tier two are stacked on top of the corresponding box-shaped units 16 of tier one and the box-shaped units 16 of tier three are stacked on top of the corresponding box-shaped units 16 of tier two. A flat horizontal sheet may be placed between the tiers of box-shaped units. In one embodiment, the interconnected locking flaps 30 and 31 are placed under a box-shaped unit 16 in the top tier. The weight of the box-shaped unit on the interconnected flaps 30 and 31 holds the corner protector 10 adjacent to the corner of the palletized load 12 such that the corner protector 10 is disposed along one of the generally vertical corners of the load 12. In this way, the four corner protectors 10 can be maintained on the corners of the palletized load 12 without an outside force being applied. Consequently, less labor is required between the box-shaped unit packing and the stretch wrap film winding steps, described below.

The plurality of sets of locking flaps 30 and 31 allow the same corner protector 10 to accommodate various size box-shaped units 16. For example, a first set 60 includes locking flaps 30 and 31 at a distance $d_1$ from the upper end 58 of the corner protector 10. A second set 62 includes locking flaps 30 and 31 at a distance $d_2$ from the upper end 58 of the corner protector 10. A third set 64 includes locking flaps 30 and 31 at a distance $d_3$ from the upper end 58 of the corner protector 10 and at a distance $d_4$ from a lower end 59 of the corner protector 10. Therefore, depending on the size of the box-shaped unit 16, the corner protector 10 can be used in either an orientation where the upper end 58 is up or the lower end 59 is up. See FIGS. 4*b* and 4*c*, respectively, where distance $d_1$ is greater than $d_4$. This allows the corner protectors 10 to be used on various assembly lines that produce different size box-shaped units 16 that are to be palletized and shipped.

Figure 5:
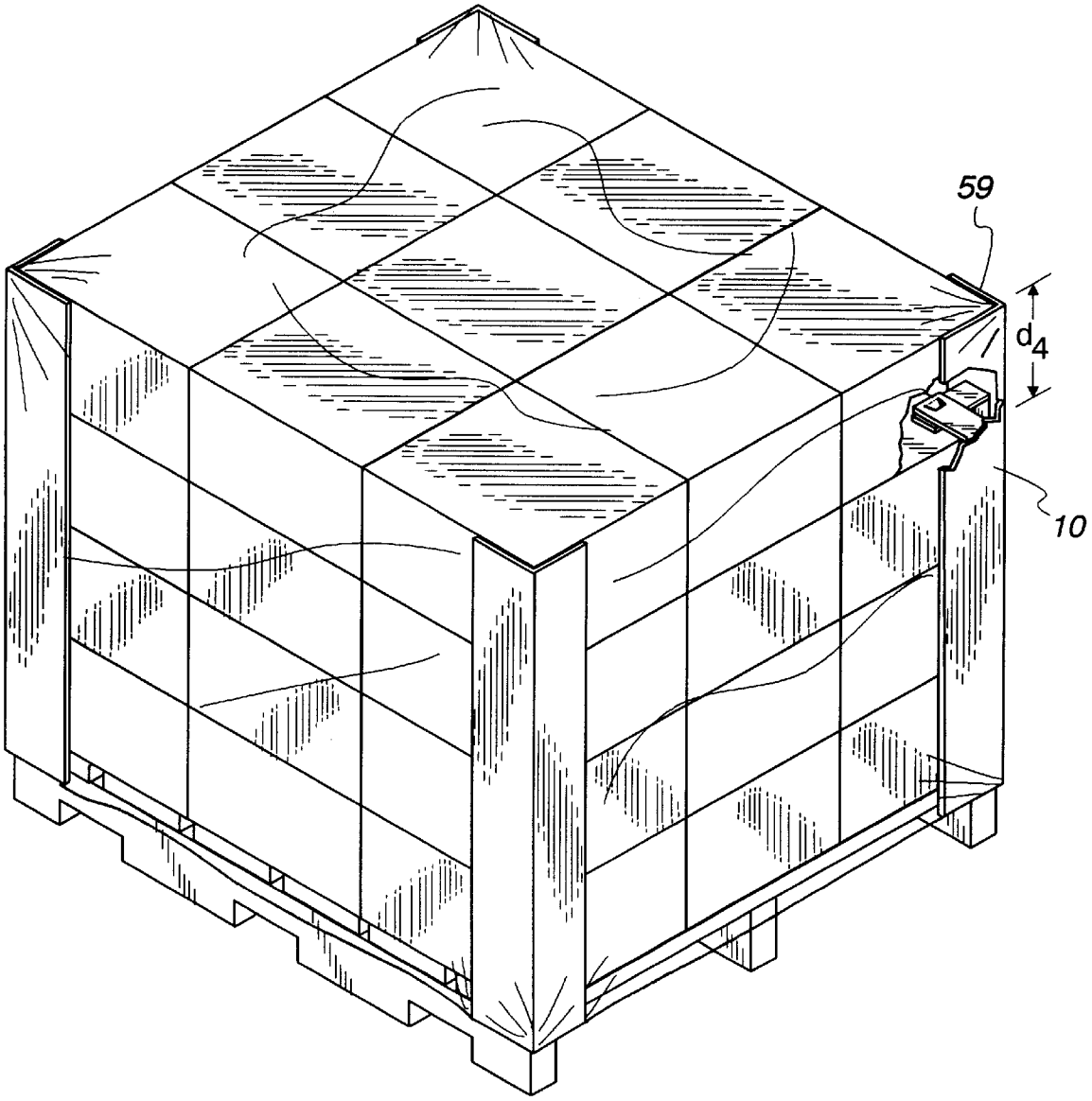
FIG. 5 is a perspective view of another palletized load with corner protectors embodying the present invention.

Referring now to FIG. 5, the corner protector 10 is depicted in an orientation where the lower end 59 is up. This means that a load of box-shaped units 16 each having a height approximately equal to the distance $d_4$ can be accommodated. Similarly, a plurality of different loads 12, each having different size box-shaped units 16, can be accommodated depending upon which set of locking tabs 30 and 31 and which orientation 58 or 59 is used. For example, where the corner protector 10 is orientated with the upper end 58 up, the second set 62, which includes locking flaps 30 and 31 at a distance $d_2$ from the upper end 58 of the corner protector 10, can be inserted between two adjacent rows of the load to accommodate large box-shaped units each having a height approximately equal to the distance $d_2$. Alternatively, the second set 62 can be inserted between two adjacent rows of box-shaped units such that two rows of box-shaped units, having a combined height approximately equal to $d_2$, are on top of the locking flaps 30 and 31 and two rows of box-shaped units are below the locking flaps 30 and 31. Alternatively, the second set 62 can be inserted between adjacent rows of box-shaped units such that one row of large box-shaped units, having a height approximately equal to $d_2$, are on top of the locking flaps 30 and 31 and two rows of smaller height box-shaped units are below the locking flaps 30 and 31.

The second set 62 can also be used in an orientation where the lower end 59 is up. Thus, box-shaped units having a height approximately equal to the distance $d_5$ can be accommodated. Alternatively, the second set 62 can be inserted between two adjacent rows of box-shaped units such that two rows of box-shaped units, having a combined height approximately equal to $d_5$, are on top of the locking flaps 30 and 31 and two rows of box-shaped units are below the locking flaps 30 and 31. Alternatively, the second set 62 can be inserted between adjacent rows of box-shaped units such that one row of large box-shaped units, having a height approximately equal to $d_5$, are on top of the locking flaps 30 and 31 and two rows of smaller height box-shaped units are below the locking flaps 30 and 31. Various other combinations of locking flaps and orientations can be used to accommodate a variety of different loads. This versatility allows a manufacturer to purchase larger quantities of the inventive corner protectors 10 and thus get a volume discount.

Prior to shipping, the box-shaped units 16 are placed on the pallet 14 with adjacent box-shaped units 16 contacting each other. The contact between adjacent ones of the box-shaped units 16 helps to maintain the stability of the palletized load 12 during movement thereof. The entire palletized load 12, consisting of the pallet 14, the box-shaped units 16, and the corner protectors 10, is transported to a stretch wrapping station. At the stretch wrapping station, the stretch wrap film 15 is spirally wound about the box-shaped units 16 to help stabilize and unitize the palletized load 12 so that movement of individual box-shaped units 16 is reduced during transportation. In an alternative embodiment, the palletized load 12 is unitized with belts or straps in place of the stretch wrap film 15.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. An assembled corner protector for protecting a load of products stacked on a pallet, said corner protector including an upper end and a lower end, said corner protector comprising:

first and second panels hingedly connected to each other along a central fold line and disposed generally perpendicular to each other, each of said first and second panels including an inner layer and an outer layer;

said inner layer of said first panel forming a first hinged locking flap disposed generally perpendicular to a remainder of said first panel;

said inner layer of said second panel forming a second hinged locking flap disposed generally perpendicular to a remainder of said second panel, said first and second locking flaps being located at approximately the same distance from said upper end and being engaged to one another to maintain said first and second panels generally perpendicular to each other.

2. The corner protector of claim 1, further including a plurality of slits intermittently located along said central fold line to help maintain said first and second panels generally perpendicular to each other.

3. The corner protector of claim 1, wherein each of said inner and outer layers of said first panel is composed of corrugated cardboard, and wherein each of said inner and outer layers of said second panel is composed of corrugated cardboard.

4. The corner protector of claim 1, wherein said inner and outer layers of said first panel are hingedly connected to each other about a first generally vertical fold line, and wherein said inner and outer layers of said second panel are hingedly connected to each other about a second generally vertical fold line.

5. The corner protector of claim 1, wherein said inner and outer layers of said first panel are adhered to each other, and wherein said inner and outer layers of said second panel are adhered to each other.

6. The corner protector of claim 1, wherein each of said first and second panels is generally rectangular in shape.

7. The corner protector of claim 1, wherein said first locking flap includes a locking tab and said second locking flap includes an aperture for receiving said locking tab.

8. The corner protector of claim 7, wherein said aperture is generally trapezoidal in shape.

9. The corner protector of claim 1, wherein said inner layer of said first panel forms a first finger hole adjacent to said first locking flap, and wherein said inner layer of said second panel forms a second finger hole adjacent to said second locking flap.

10. An assembled corner protector for protecting a load of products stacked on a pallet, said corner protector including an upper end and a lower end, said corner protector comprising:

first and second generally rectangular panels hingedly connected to each other along a central fold line and disposed generally perpendicular to each other, each of said first and second panels including an inner layer and an outer layer; and a plurality of sets of first and second hinged locking flaps, said first locking flaps being formed from said inner layer of said first panel, said second locking flaps being formed from said inner layer of said second panel, said first and second locking flaps in a respective one of said sets being hinged at approximately the same distance from said upper end of said corner protector, said first and second locking flaps in one of said sets being disposed generally perpendicular to remainders of said respective first and second panels and being engaged to one another to maintain said first and second panels generally perpendicular to each other.

11. The corner protector of claim 10, wherein said plurality of sets of first and second locking flaps includes two sets, said first and second locking flaps in a first of said two sets being hinged at approximately a first distance from said upper end of said corner protector, said first and second locking flaps in a second of said two sets being hinged at approximately a second distance from said lower end of said corner protector.

12. The corner protector of claim 11, wherein said first distance is not equal to said second distance.

13. The corner protector of claim 10, wherein said plurality of sets of first and second locking flaps includes three sets, said first and second locking flaps in a first of said three sets being hinged at approximately a first distance from said upper end of said corner protector, said first and second locking flaps in a second of said three sets being hinged at approximately a second distance from said upper end of said corner protector, said first and second locking flaps in a third of said three sets being hinged at approximately a third distance from said upper end of said corner protector.

14. The corner protector of claim 10, further including a plurality of slits intermittently located along said central fold line to help maintain said first and second panels generally perpendicular to each other.

15. The corner protector of claim 10, wherein each of said inner and outer layers of said first panel is composed of corrugated cardboard, and wherein each of said inner and outer layers of said second panel is composed of corrugated cardboard.

16. The corner protector of claim 10, wherein said inner and outer layers of said first panel are hingedly connected to each other about a first generally vertical fold line, and wherein said inner and outer layers of said second panel are hingedly connected to each other about a second generally vertical fold line.

17. The corner protector of claim 10, wherein said inner and outer layers of said first panel are adhered to each other, and wherein said inner and outer layers of said second panel are adhered to each other.

18. The corner protector of claim 10, wherein said first locking flap includes a locking tab and said second locking flap includes an aperture for receiving said locking tab.

19. A method of forming a corner protector for protecting a load of products stacked on a pallet, said corner protector including an upper end and a lower end, said method comprising the steps of:

(a) forming first and second panels each having an inner layer and an outer layer;

(b) forming a central fold line between said first panel and said second panel;

(c) folding said first and second panels relative to each other such that said first panel and said second panel are disposed generally perpendicular to each other;

(d) forming a first hinged locking flap from said inner layer of said first panel;

(e) forming a second hinged locking flap from said inner layer of said second panel;

(f) folding said first and second hinged locking flaps such that each is disposed generally perpendicular to remainders of said respective first and second panels;

(g) engaging said first hinged locking flap with said second hinged locking flap such that said first and second panels are maintained generally perpendicular to each other; and (h) forming said first hinged locking flap and said second hinged locking flap at approximately the same distance from the upper end of said corner protector.

20. The method of claim 19, further including the step of forming a plurality of slits intermittently located along said central fold line to help maintain said first and second panels generally perpendicular to each other.

21. The method of claim 19, wherein said inner and outer layers of each of said first and second panels are composed of corrugated cardboard.

22. The method of claim 19, further including the steps of adhering said inner and outer layers of said first panel to each other and adhering said inner and outer layers of said second panel to each other.

23. The method of claim 19, further including the steps of providing said first locking flap with a locking tab and providing said second locking flap with an aperture for receiving said locking tab.

24. The method of claim 19, further including the steps of forming said inner layer of said first panel with a first finger hole adjacent to said first locking flap and forming said inner layer of said second panel with a second finger hole adjacent to said second locking flap.

25. A method for installing a corner protector on a palletized load for protecting said load, said method comprising the steps of:

supplying said load on a pallet, said load including a plurality of vertical corners and a plurality of rows of products;

supplying a corner protector having an upper end and a lower end including first and second panels hingedly connected to each other along a central fold line, said first and second panels being disposed generally perpendicular to each other, each of said first and second panels including an inner layer and an outer layer, said inner layer of said first panel forming a first hinged locking flap disposed generally perpendicular to a remainder of said first panel, said inner layer of said second panel forming a second hinged locking flap disposed generally perpendicular to a remainder of said second panel, said first and second locking flaps being located at approximately the same distance from said upper end and being engaged to one another to maintain said first and second panels generally perpendicular to each other; and inserting said engaged first and second locking flaps along one of said rows such that said corner protector is disposed along one of said generally vertical corners of said load.

26. The method of claim 25, further including the step of installing additional corner protectors identical to said corner protector along remaining ones of said generally vertical corners of said load.

27. The method of claim 26, further including the step of wrapping stretch wrap film around said pallet and said corner protectors to secure said load for shipping.

28. A corner protector for protecting first and second palletized loads of products, said first load of products each having a first height, said second load of products each having a second height, said corner protector having an upper end and a lower end, said corner protector comprising:

first and second panels hingedly connected to each other along a central fold line and disposed generally perpendicular to each other, each of said first and second panels including an inner layer and an outer layer;

said inner layer of said first panel forming a first hinged locking flap disposed generally perpendicular to a remainder of said first panel;

two sets of first and second hinged locking flaps, said first and second locking flaps in a first of said two sets being hinged at approximately a first distance from said upper end of said corner protector, said first and second locking flaps in a second of said two sets being hinged at approximately a second distance from said lower end of said corner protector;

flaps in one of said sets being disposed generally perpendicular to remainders of said respective first and second panels and being engaged to one another to maintain said first and second panels generally perpendicular to each other;

wherein in a first orientation protecting said first load, said first and second locking flaps in a first of said two sets being disposed generally perpendicular to remainders of said respective first and second panels and being engaged to one another to maintain said first and second panels generally perpendicular to each other; and wherein in a second orientation protecting said second load, said first and second locking flaps in a second of said two sets being disposed generally perpendicular to remainders of said respective first and second panels and being engaged to one another to maintain said first and second panels generally perpendicular to each other.

29. The system of claim 28, wherein said first orientation corresponds to said upper end being up and wherein said second orientation corresponds to said lower end being up.

30. The system of claim 28, wherein said first and second locking flaps of said first set are hinged at approximately a first distance from said upper end of said corner protector, said first and second locking flaps of said second set are hinged at approximately a second distance from said lower end of said corner protector.

31. The system of claim 30, wherein said first distance is not equal to said second distance.

* * * * *